United States Patent [19]

Ohe et al.

[11] Patent Number: 4,838,767

[45] Date of Patent: Jun. 13, 1989

[54] BALANCED VANE TYPE OIL PUMPS

[75] Inventors: Takeshi Ohe; Hiroshi Ohsaki, both of Higashimatsuyama, Japan

[73] Assignee: Jidosha Kiki Co., Ltd., Japan

[21] Appl. No.: 553,302

[22] Filed: Nov. 18, 1983

[30] Foreign Application Priority Data

Nov. 22, 1982 [JP] Japan ..... 57-205116

[51] Int. Cl.[4] ..... F04G 49/08

[52] U.S. Cl. ..... 417/299; 417/302; 417/304; 417/308; 417/310

[58] Field of Search ..... 417/286, 288, 302, 304, 417/308, 299, 310

[56] References Cited

U.S. PATENT DOCUMENTS 2,887,060 5/1959 Adams et al. ..... 417/310 X
4,408,964 10/1983 Mochizuki et al. ..... 417/315

FOREIGN PATENT DOCUMENTS 57-79281 5/1982 Japan ..... 417/286
2090915 7/1981 United Kingdom ..... 417/286

*Primary Examiner*—Richard E. Gluck
*Attorney, Agent, or Firm*—Remy J. VanOphem

[57] ABSTRACT

Inlet passages and two sets of discharge passages are communicated with a pair of pump chambrs formed in a pump cartridge in a pump body. A pair of spool valves respectively acting as a flow quantity control valve and a pressure sensitive type flow path switchng valve are formed in parallel in the pump body in directions perpendicular to the axis of the pump.

4 Claims, 10 Drawing Sheets

BALANCED VANE TYPE OIL PUMPS

BACKGROUND OF THE INVENTION

This invention relates to a balanced vane type oil pump and, more particularly, to an oil pump wherein a pump cartridge is used as two pumps and the supply of pressurized liquids from both pumps is selectively controlled to reduce consumption.

For example, an oil pump used as a source of pressurized oil of a power steering apparatus utilized to decrease the steering effort required of a driver of a motor car is usually driven by the engine of the car so that the output of the pump varies in proportion to the number of revolutions of the engine. Accordingly, such pump should have a capacity sufficient to insure satisfactory operation of the power steering apparatus or any similar liquid pressure apparatus even in a low speed operational range of the engine at which time the output quantity of the pump is small.

However, when the pump capacity is set in this manner, an excessive quantity of pressurized oil would be supplied to the liquid pressure apparatus during high speed engine operation, which is not only useless but which also increases the engine horsepower required for driving the pump, resulting in a larger consumption of fuel.

To solve this problem, it has been proposed to use a pair of pump cartridges as two pumps, each having a small capacity, and to combine a control unit with the pump cartridges. The control unit acts as a flow path switching mechanism for selectively supplying the outputs of both pumps to the liquid pressure apparatus. Thus, according to this arrangement, when the outputs of the respective pumps are small they are combined for use, whereas when the outputs increase, the output of only one pump is supplied to the power steering apparatus or similar pressure liquid apparatus and the output of the other pump is returned to the oil reservoir, thus circulating the oil through the other pump without utilizing the work generated by the pump resulting in wasted power consumed by the pump.

The arrangement described above is constructed such that it switches the flow paths based on the output of the respective pumps as well as on the speed of the engine, so that although it is possible to decrease the power consumption during the high speed operation of the vehicle, in the low speed range, the power consumption by both pumps is not avoidable.

Thus, this arrangement involves many problems which must be solved.

More particularly, in the power steering apparatus of the type described above, the quantity of the pressurized oil presents a problem under a high load state requiring larger output of the pump, that is, when the power steering is used at low speed and when the car is not running or running on a straight road. Further, the quantity of the pressurized oil supply is also small when the engine is running in the low speed range. Usually, in this situation the car is operating in a city, for example, in ten mode running patterns, in which it is necessary to reduce power consumption due to the low speed operation.

For this reason, it is advantageous to use a control unit having a flow path switching mechanism that senses the load of the power steering apparatus. Such a mechanism, however, presents the problem that even when the engine runs at a high speed so that the output of only one pump is sufficient, the flow path switching in response to load requires the use of both pumps, thus increasing power consumption.

It has also been proposed to use a flow path switching mechanism in which the running speed of the vehicle is electrically detected and the detected electric signal is utilized for effecting the flow path switching. However, since the vehicle speed is not always proportional to the number of revolutions of the engine, that is the pump output, this mechanism, responding solely to vehicle speed, cannot efficiently decrease the power consumption. A truck carrying excessive load may be running at a low speed with the engine operating in the high speed range, thus reducing pump output when it is required the most. Furthermore, such a flow path switching mechanism requires the use of electrical sensors and an electromagnetic valve operated thereby which is expensive.

The control unit described above to control the supply quantity of the pressurized liquid is required to selectively switch the flow paths from both oil pumps when desired, and to control the quantity of fluid to be supplied to the liquid pressure apparatus to a predetermined level. These two requirements are generally accomplished by using a pair of spool valves and a number of pressure liquid flow passages adapted to suitably combine these valves. Such construction, however, increases the cost of manufacturing and assembling the oil pump because the pair of spool valves and the flow paths are all incorporated in a single pump body together with a pair of pump cartridges.

There is also a constructional problem when a pair of pump cartridges consisting of rotors including vanes and cam rings are used as two pumps.

More particularly, for the purpose of utilizing a pair of pump cartridges as two pumps, the simplest construction is to use a pair of pump chambers formed at positions symmetric with respect to the rotor axis with the pump chambers independently connected to individual output passages. Examples of such constructions are disclosed in Japanese Laid Open Patent Specification Nos. 82868/1980 and 49594/1980 (U.S. Pat. No. 4,289,454). Although such constructions can simplify the layout of the pump passages and of the control unit, when the output of one pump chamber is connected to the reservoir side for unloading of same so that the pumping action is performed by only the other pump chamber, an unbalanced load is applied to the rotor and its rotary shaft, thus decreasing the durability and the operational reliability of the moving parts of the pump. In addition, such construction produces noises that make this pump impractical.

A balanced vane type oil pump free from these problems is disclosed in U.S. Pat. No. 2,887,060. In this patent a pair of pump chambers, formed about a rotor at positions symmetrical with respect to the axis of the rotor, are connected with two independent discharge passages which open into the respective pump chambers at positions symmetrical with reference to the rotor axis, so that the single rotor pump acts as two independent pumps. This construction, however, increases the number of fluid flow passages and complicates the connections of these passages to the spool valves of the control unit.

Since the pump cartridges, control unit, and flow passages are incorporated into a single pump body to form an oil pump, the problems described above have a large influence upon the manufacture, assembly, and cost of the pump and tend to increase the size of the pump.

It is desirable for a pump of this type to be of a simple construction, easy to assemble, and to have a small size and weight as well as low cost. These characteristics are advantages when the pump is to be installed in a small space in an engine compartment, for example, to drive a power steering apparatus. Accordingly, development of an energy saving type oil pump that can satisfy all of these requirements sought is needed.

SUMMARY OF THE INVENTION

According to the present invention an oil pump consisting of a pump body including a rotor provided with a plurality of radially movable vanes and a cam ring rotatably containing the rotor to define a pair of pump chambers is provided. The pump body is provided with inlet passages and first and second discharge passages opening into the pump chambers at a predetermined spacing in relation to the direction of rotation of the rotor. The pump body contains two parallel spool valve bores extending in a direction substantially perpendicular to the shaft of the rotor. A first spool is contained in one of the spool valve bores to act as a flow quantity control valve for selectively connecting the first discharge passage to the inlet passage, and a second spool is contained in the other valve opening to act as a flow path switching valve for selectively connecting the second discharge passage to either the first discharge passage or to the inlet passage.

Accordingly, it is an object of the present invention to provide an improved balanced vane type oil pump capable of decreasing the number of component parts, size, and weight.

Another object of the present invention is to provide an improved balanced vane type oil pump that can be readily manufactured and assembled and can save energy.

DETAILED DESCRIPTION OF THE PREFERRED EMBODIMENT

The preferred embodiment of the oil pump shown in FIGS. 1 through 4 is used for operating a power steering apparatus of a motor car.

Figure 1:
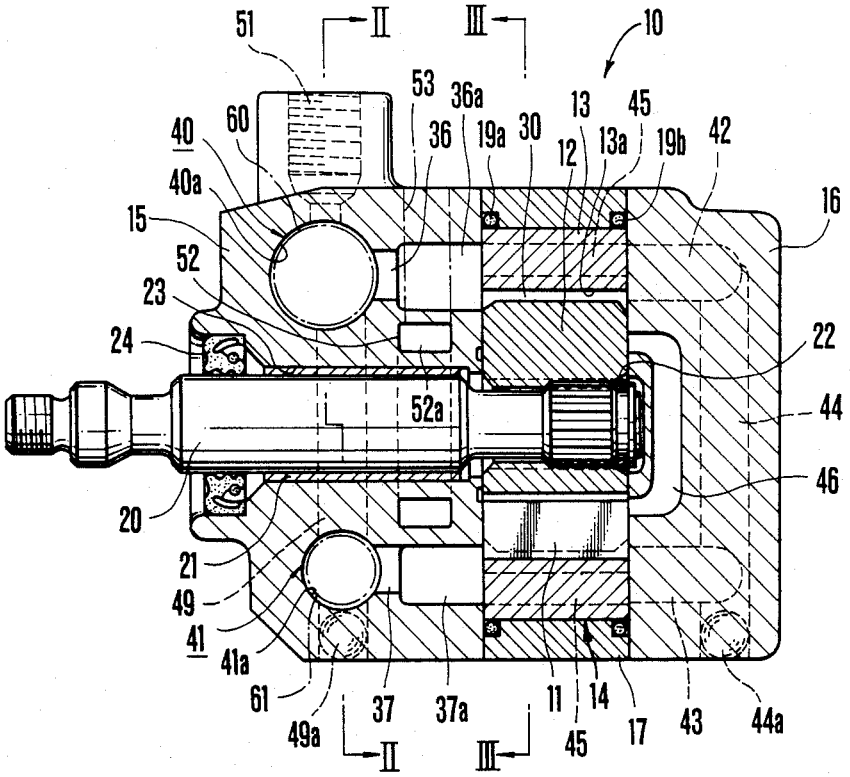
FIG. 1 is a longitudinal sectional view showing one embodiment of the oil pump according to the present invention.
Figure 2:
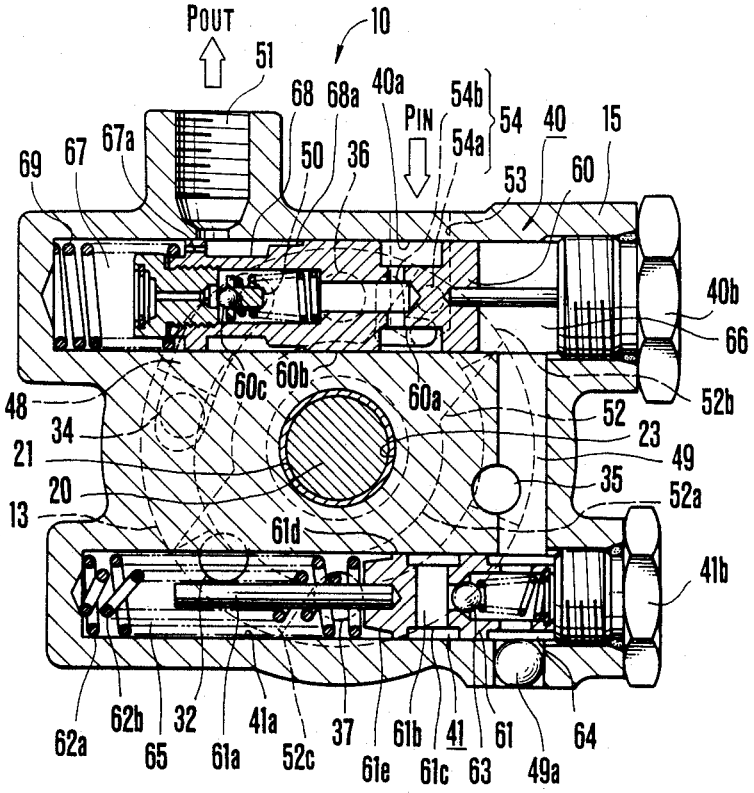
FIG. 2 is a cross-sectional view of the oil pump shown in FIG. 1 taken along line II—II.
Figure 3:
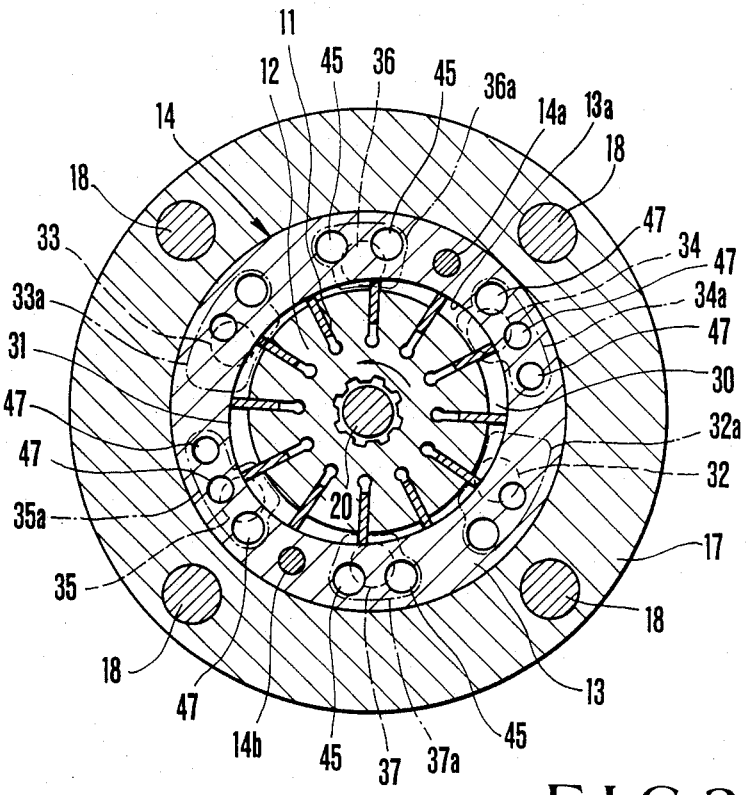
FIG. 3 is a cross-sectional view of the oil pump shown in FIG. 1 taken along line III—III.
Figure 4:
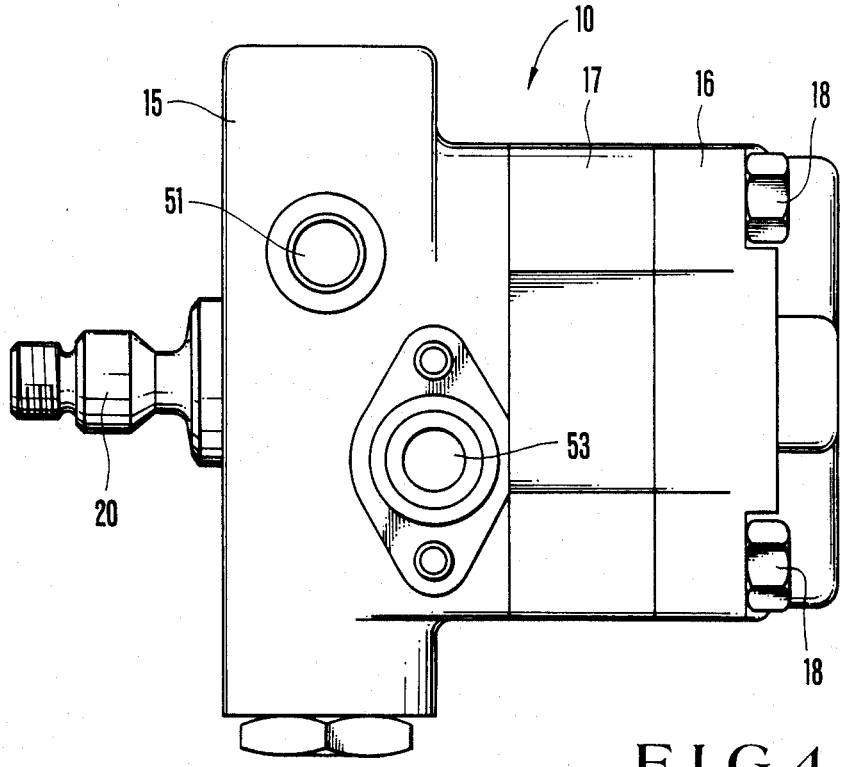
FIG. 4 is a plan view of the oil pump.

In these drawings, the oil pump generally designated by a reference numeral 10, consists of a pump cartridge 14, a rotor 12 provided with a plurality of radially extending vanes 11, and a cam ring 13 encircling the rotor 12 and having a substantially elliptical cam surface 13*a*. The opposing sides of the pump cartridge 14 are directly contacting a front body 15 and a rear body 16, respectively, which together constitute the pump body assembly. The front and rear bodies 15 and 16, respectively, are secured by four circumferentially spaced bolts 18 which clamp the cam ring 13, surrounding the rotor 12, and an outer annular member 17, surrounding the cam ring 13, therebetween. Thus, according to the present invention, it is possible to eliminate a side plate and a pressure plate which have been necessary in a prior art oil pump. By reducing the number of component parts, the number of assembling steps are fewer and the overall size of the pump is smaller with a resultant decrease in weight. Because the discharge pressure is low in a small oil pump of this type, the pump operation is not disturbed even when the pump cartridge 14 is secured directly between the front and rear bodies 15 and 16. FIG. 1 illustrates O rings 19*a* and 19*b* adapted to seal abutting surfaces of the pump cartridge 14 and the front and rear bodies 15 and 16. The rotor 12 is provided with a plurality of radial slots to slidably receive the radially extending vanes 11 which move toward and away from the inner wall of the elliptical cam surface 13*a* of the cam ring 13 and define the pump chambers. In FIG. 2, these vanes are not shown. FIG. 3 illustrates two pins 14*a* and 14*b*, which secure the cam ring against rotation within the pump cartridge 14.

With reference to FIGS. 1 through 4, the front body 15 has a substantially cylindrical configuration such that its one side surface abuts to one side of the pump cartridge 14. A rotary shaft 20 of the rotor 12 is driven by the engine and extends coaxially with the axis of the front body 15. The rotary shaft 20 is rotatably journalled by a sleeve bearing 21. The inner end of the rotary shaft 20 is spline coupled with the rotor 12 and secured by a snap ring 22 which prevents separation of the spline coupling. A shaft opening 23 through which the rotary shaft 20 extends is formed along the axis of the front body 15 and an oil seal 24 is used for sealing the rotating shaft where it extends from the outer end of the shaft opening.

As shown in FIGS. 1 and 3, the inlet ports 32*a* and 33*a* communicate with a pair of pump inlet passages 32 and 33 which open, respectively, in a pair of pump chambers 30 and 31 formed at symmetrically opposed positions with respect to the rotor 12 in the pump cartridge 14. A first and second pair of discharge ports 34*a* and 35*a*, and 36*a* and 37*a*, communicate, respectively, with a first and second pair of pump discharge passages 34 and 35, and 36 and 37, which open into the respective pump chambers 30 and 31 at a predetermined spacing relative to the direction of rotation of the rotor 12. The pair of inlet ports 32*a* and 33*a*, the first discharge ports 34*a* and 35*a*, and the second discharge ports 36*a* and 37*a*, respectively, communicate with the pump chambers 30 and 31 and are located symmetrically opposed with respect to the axis of the rotor 12. The pressurized oil discharged from the pair of first and second discharge ports 34*a* and 35*a* and 36*a* and 37*a* is supplied to the independent oil discharge passages 34 and 35 and 36 and 37 so as to create two independent pumping circuits.

As described above, since the pump cartridge 14 is utilized as two pumping circuits or portions by dividing the discharge of the respective pump chambers 30 and 31 into two portions, formed at positions symmetrical with respect to the axis of the rotor 12, a well balanced pump operation can be obtained by combining appropriate paired portions. With this balanced two stage pump, when one of the discharge ports is short circuited for unloading, a balanced load will be applied on the rotor 12 so that unbalanced wear of the rotary portions of the pump can be prevented, thus improving the durability and reliability of the pump. In addition, any noises associated with pumping are eliminated.

According to the present invention, the pump inlet passages 32 and 33, which supply pressurized oil from a supply tank to the respective pump chambers 30 and 31 in the pump cartridge 14, and the first and second pairs of pump discharge passages 34 and 35, and 36 and 37, which supply pressurized oil discharged by the pump action in two directions, are uniquely disposed in the front and rear bodies 15 and 16 together with a pair of spool valves 40 and 41. One of the spool valves acts as a flow control valve while the other spool valve is a pressure sensitive type flow path switching valve. In combination, the spool valves act as a control unit controlling the flow of the pressurized oil, by taking into consideration the relation between the inlet and discharge passages. Consequently, the size and weight of the pump can be reduced and the machining operations of the pump can be significantly reduced.

More particularly, as shown in FIGS. 1 and 2, the front body 15 on the front side of the pump cartridge 14 is formed with a pair of valve bores 40*a* and 41*a* on the opposing sides of the rotary shaft 20 of the rotor 12. The valve bores 40*a* and 41*a* extend in a plane parallel with the plane of the axis of the rotary shaft 20 and are substantially at right angles with respect thereto. The openings of the pair of valve bores 40*a* and 41*a* are on one side of the front body 15 and are closed against oil leakage by sealing plugs 40*b* and 41*b*, respectively.

As shown in FIGS. 1, 2, and 3, the second pump discharge passages 36 and 37, which pass the pressurized oil from the pump chambers 30 and 31, open at about the axial centers of the first and second valve bores 40*a* and 41*a*, respectively. These second pump discharge passages 36 and 37 are interconnected with respective grooves 42 and 43, which are disposed opposite the second discharge ports 36*a* and 37*a* on the side of the rear body 16. These grooves open into the pump chambers 30 and 31, respectively, and a passage 44 interconnects the grooves 42 and 43. The second discharge ports 36*a* and 37*a* and the grooves 42 and 43 are respectively interconnected by a plurality of passages 45 in the cam ring 13, as shown in FIGS. 1 and 3. This arrangement can supply and combine pressurized oils discharged from both chambers 30 and 31 to the second pump discharge passages 36 an d 37 with sufficiently large flow path areas. As shown in FIG. 1, the opening of the passage 44 bored through the rear body 16 is closed by a ball 44*a*. However, when the passage 44 is manufactured with a casting core together with the grooves 42 and 43, it is not necessary to use the ball 44*a*.

The first discharge ports 34*a* and 35*a* are interconnected by a communicating passage 46 (a portion thereof being shown in FIG. 1) formed in the rear body 16 and has substantially the same general construction as the grooves 42 and 43 which interconnect the second discharge ports 36*a* and 37*a* with the passage 44. In this construction, a passage 47 in the cam ring 13 combines the pressurized oils from the pump chambers 30 and 31 and supplies the combined oil to the first pump discharge passages 34 and 35. As shown in FIG. 2, the first pump discharge passage 34 is connected to one end of a groove 48, formed by a casting core in the front body 15, and the other end of the groove 48 opens into the first valve bore 40*a* at a portion near the bottom thereof. The other first pump discharge passage 35 is connected to an intermediate point of a passage 49 formed in the front body 15 for interconnecting the first and second valve bores 40*a* and 41*a* at their opening ends in the front body 15. An orifice 50 is formed between the groove 48 and the first valve bore 40*a* for detecting the quantity of oil flow to the liquid pressure spool apparatus so as to actuate the spool valve 40 which functions as a flow control valve as will be described later. A discharge port 51 opening out of the upper portion of the front body 15 is provided for the first spool valve bore 40*a* at an area slightly displaced from the location of the orifice 50. The opening end of the passage 49 is closed by a ball 49*a*.

The other ends of the pump inlet passages 32 and 33, connected with the inlet ports 32*a* and 33*a*, are connected to the bottom side of the second valve bore 41*a* at portions of the first valve bore 40*a* near the center of the passage 49. These pump inlet passages 32 and 33 are interconnected by a connecting passage 52 formed between the valve bores 40*a* and 41*a* and the abutting surfaces with the pump cartridge 14 and the front body 15. The connecting passage 52 is connected to an inlet port 53 formed at the upper portion of the front body 15. The connecting passage 52 is defined by an annular portion 52*a* formed about the shaft opening 23 in the front body 15 and extension portions 52*b* and 52*c* extending toward the pump inlet passages 32 and 33 from the annular portion 52*a* which is formed in the front body 15 by using a casting core. Although in this embodiment, an opening 54 of the pump inlet side passage 33 is connected to the first valve bore 40*a*. This opening 54 is formed by a small opening 54*a* formed by machining and a substantially L-shaped opening 54*b* formed by casting. The opening 54 is utilized to improve the operating accuracy of the spool valve 40, acting as the flow control valve, and further serves to establish a return passage for returning the pump output to the inlet side.

Spools 60 and 61 are mounted in the first and second spool valves 40 and 41 and respectively act as the flow control valve and the flow path switching valve.

More particularly, the spool 61 incorporated into the second valve bore 41*a* is normally biased toward the open end by a pair of springs 62*a* and 62*b* also contained inside the spool valve bore 41*a*. Under this condition, the discharge passage 37 of the first pump circuit and the inlet passage 32 of the second pump circuit are interconnected by an annular space about a rod 61*a* projecting from the spool 61, whereby the pressurized oil returns to the inlet side from the discharge passage 37 of the second pump circuit. A check valve 63 is disposed in the opening end of the spool 61. The check valve 63 is connected to the pump discharge passage 37 through an opening 61*b* and an annular groove 61*c* on the outside of the spool when the spool 61 moves towards the bottom side of the valve bore 41*a*. At this time, the land portion 61*d* of the spool 61 interrupts the communication between the second pump discharge passage 37 and the pump inlet passage 32. The check valve 63 is opened by the pressurized oil from the second pump discharge passage 37 so as to pass the pressurized oil to the communication passage 46, connected with the first pump discharge passage 34 via the passage 49 opening into the opened end of the valve bore 41*a* and the first pump discharge passage 35, for combining the discharged pressurized oil in the first pump discharge passages 34 and 35. In the spool valve 41 constructed as described above, the pressurized oil in the first pump discharge passages 34 and 35 is introduced into a high pressure chamber 64 formed at the opened end of the spool 61, while the pressurized oil on the inlet side is introduced into a low pressure chamber 65 via the pump inlet passage 32. The spool 61 senses the oil pressure in the main supply passage consisting of the first pump discharge passages 34 and 35. The pressure in the communication passage 46 and the groove 48, having the orifice 50, rises due to the increase in the load of the liquid apparatus. Thus, the spool 61 functions as a pressure sensitive type flow path switching valve.

The reason for using large and small springs 62*a* and 62*b* to bias the spool 61 toward the opened end of the valve bore 41*a* is to alleviate excessive pressure rise caused by rapid flow of the pressurized oil into the main supply passage from the second pump discharge passage 37 when the spool is operated. The biasing force exerted by the large and small springs 62*a* and 62*b* upon the spool 61 have nonlinear characteristics so as to cushion the movement of the spool 61. An annular groove 61*e* formed at the bottom of the spool 61 is used for the same purpose.

The spool 60 contained in the first valve bore 40*a* acts as a well known flow quantity control valve, but in this embodiment, since the second pump discharge passage 36 is opened at the axial center of the bore, the spool 60 also acts as the flow path switching valve. More particularly, the pressurized oil in the first pump discharge passage 35, that is, on the upstream side of the flow quantity detection orifice 50, is introduced into a high pressure chamber 66 formed at the opened end of the valve bore 40*a* by the spool via the passage 49. The pressurized oil on the downstream side of the orifice 50 is introduced into a stepped annular groove 68, formed on the side of the low pressure chamber 67 at the rear end of the spool 60, through the groove 48 communicating with the first pump discharge passage 34. The spool 60 is normally biased toward the opened end of the valve bore 40*a* by a spring 69 disposed in the low pressure chamber 67. The annular groove 60*a* on the outside of the central portion of the spool 60 aligns with the opening 54 of the pump inlet passage 33 connected to the inlet port 53, thereby disconnecting the first pump discharge passages 34 and 35 from the pump inlet passage 33. At this time, the land 60*b* of the spool 60 closes the opened end of the pump discharge passage 36. When the quantity of pressurized oil sent into the first pump discharge passages 34 and 35 from the pump chambers 30 and 31 exceeds a predetermined value, the spool 60 is moved in the valve bore 40*a* by the pressure difference between the upstream and downstream sides of the orifice 50 to thereby connect the first pump discharge passage 35 with the pump inlet passage 33 which results in returning the pressurized oil, exceeding a predetermined quantity, to the inlet side of the pump. As shown in FIG. 2, an orifice 67*a* for preventing vibration of the spool 60 and a well known relief valve 60*c* are contained in the spool 60.

The reason for stepping the annular groove 68 of the spool into which the orifice 50 opens is that by operation of the spool 60, the orifice 50 is variably throttled by a large diameter portion 68*a* of the annular groove so as to gradually decrease the quantity of the pressurized oil from the discharge port 51 to provide a so called drooping function which is effective to make rigid the handle when the vehicle runs at a high speed to improve the running stability.

The operation of the oil pump 10 provided with the control unit described above will now be described with reference to FIGS. 5*a* through 5*d* in which $P_1$ designates the first pump or pump circuit consisting of the first pump discharge passages 34 and 35; $P_2$ designates the second pump or pumping circuit consisting of the second pump discharge passages 36 and 37; T designates a tank communicated with the pump inlet passages 32 and 33; and PS designates a power steering apparatus to be operated. Other component elements are designated by the same reference numerals as those shown in FIGS. 1 through 4.

Figure 5A:
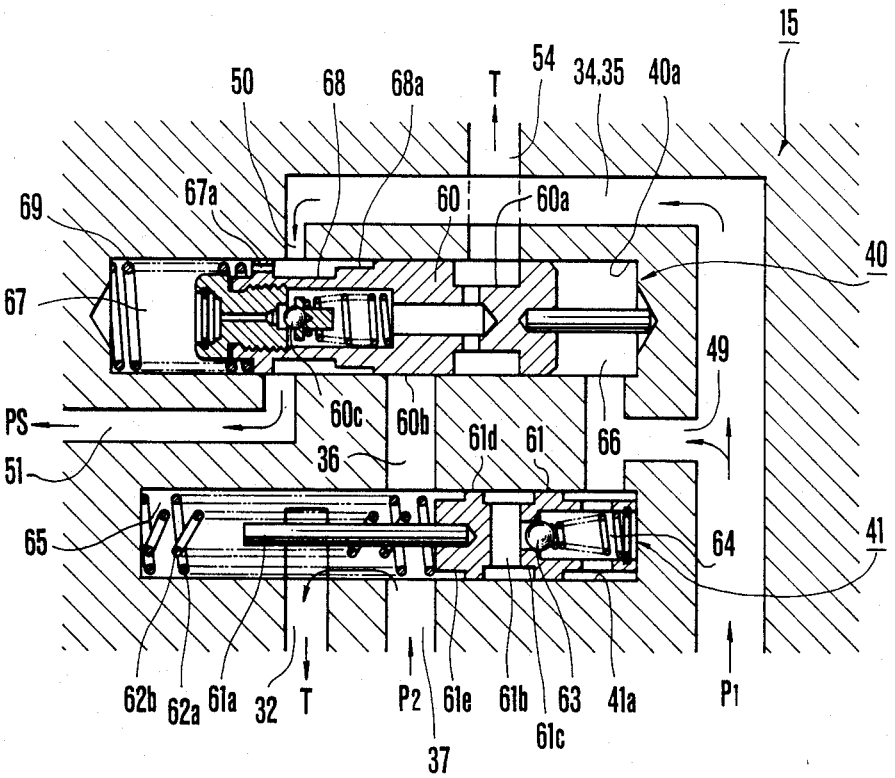
FIGS. 5*a* through 5*d* are partial longitudinal sectional views diagrammatically depicting the various operating modes of a control unit which responds to pump rotor speed and oil pressure.

FIG. 5*a* shows a state in which the engine rotates at a low speed and the power steering device PS is in an inoperative state, that is, no load is applied to the power steering apparatus PS so that the oil pressure in the main supply path from the first oil pump $P_1$ (consisting of the first pump discharge passages 34 and 35, communication passage 46, passage 47, and groove 48 having an orifice 50) is low. Under this state, both of the first and second spool valves 40 and 41 are maintained in the non-operative state with the result that the pressurized oil from the first pump $P_1$ is supplied to the power steering apparatus PS through the main passage, while the second pump $P_1$ is connected to the tank T via the second pump discharge passage 37 and the pump inlet passage 32 so that the pressurized oil circulates through the second pump $P_2$ and the tank T to maintain the no load state. Even if the quantity of the pressurized oil supplied is small, the operation of the power steering apparatus is not affected. The flow quantity characteristic under this state is shown by a solid line a in FIG. 6, and the power consumption under these conditions is shown by a solid line a in FIG. 7 which is less than about one half of that of the prior art (shown by dotted line b in FIG. 7).

Figure 6:
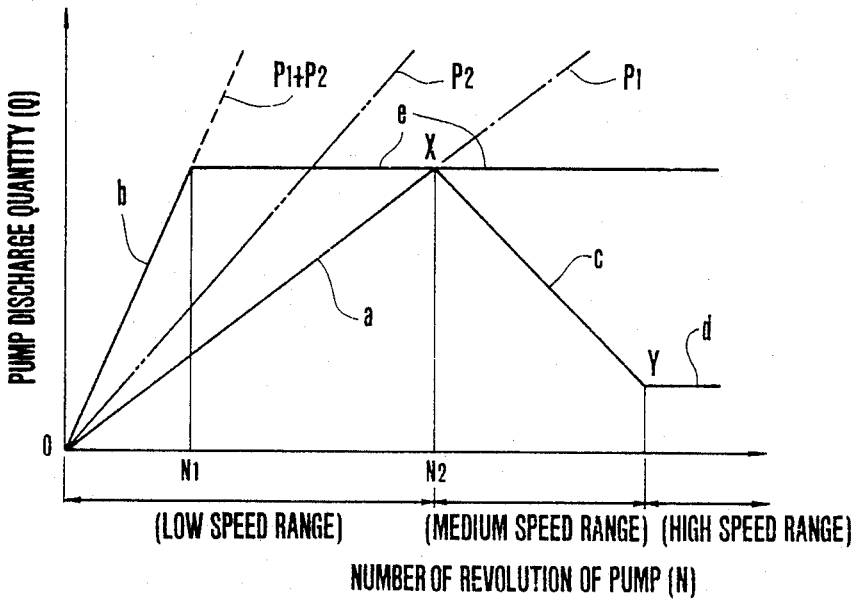
FIG. 6 is a graph showing the relationship between the number of revolutions of the pump and the pump output.

In FIG. 6, $P_1$ shows the relation between the number of revolutions of the pump and the discharge quantity of the first pump $P_1$; $P_2$ that of the second pump; and $P_1+P_2$ that of the sum of the discharged quantities.

Figure 7:
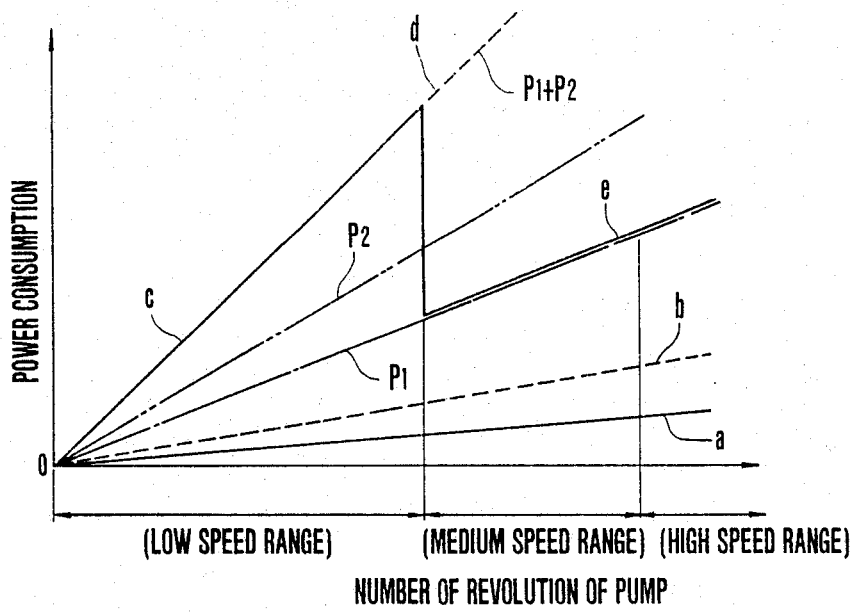
FIG. 7 is a graph showing the relationship between the revolutions of the pump and the pump power consumption.

FIG. 7 shows the relationship between the power consumption and the number of revolutions of the pump in which $P_1$ shows the power consumption of the first pump $P_1$; $P_2$ that of the second pump $P_2$; and $P_1+P_2$ the sum of the combined power consumptions.

Figure 5B:
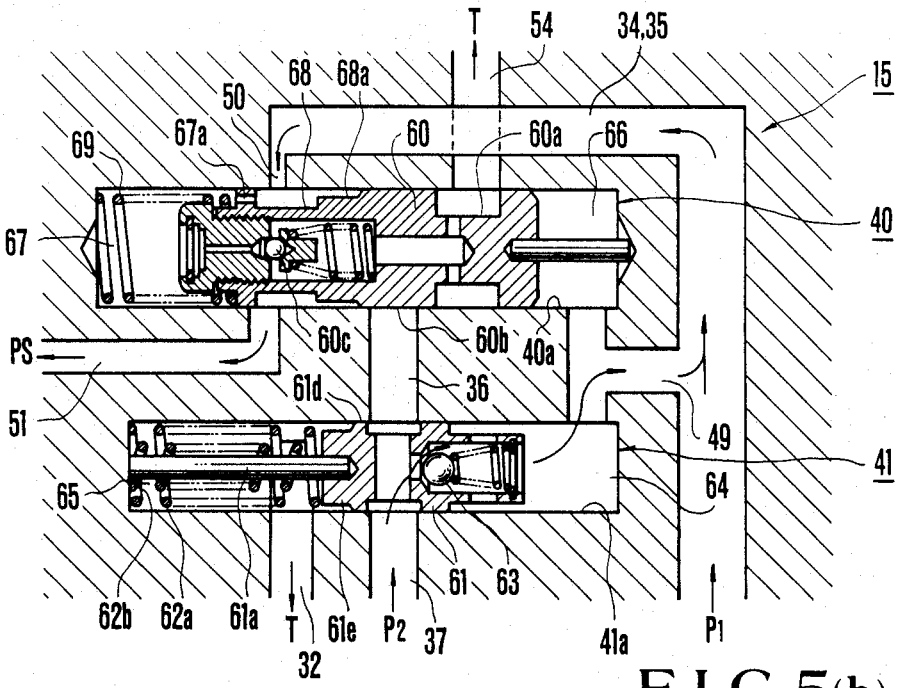
Figure 5C:
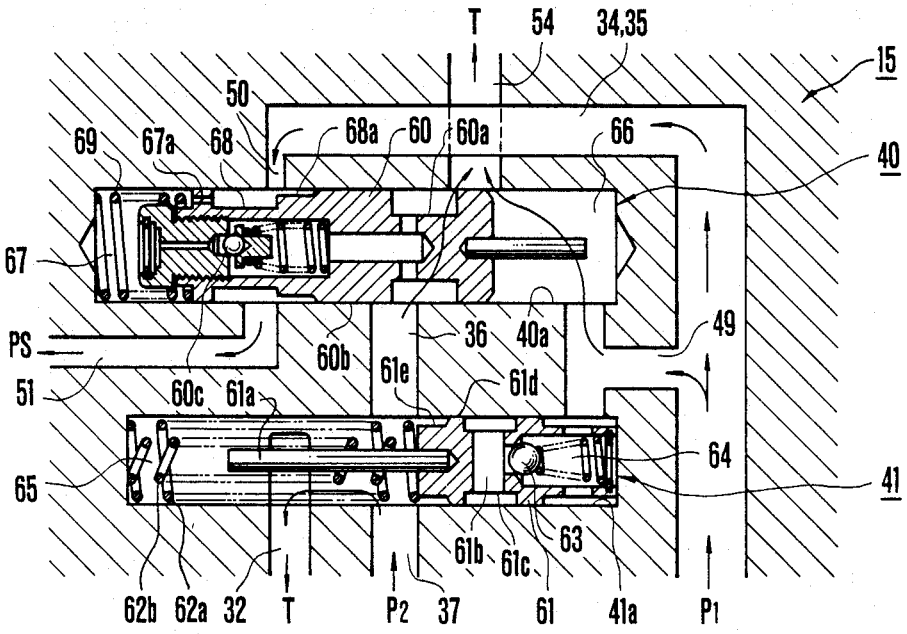

When the load increases as a result of the operation of the power steering apparatus so that the state changes from the low speed low pressure state to the low speed high pressure state, the second spool valve 41 operates as shown in FIG. 5*b* to disconnect the second pump $P_2$ from the tank T and connect the second pump $P_2$ to the main path through the check valve 63. As a consequence, the pressurized oil from the second pump $P_2$ is combined with the pressurized oil from the first pump $P_1$ in the main path and the combined oil is supplied to the power steering apparatus PS to create a required auxiliary steering power without any difficulty. The flow quantity characteristic when the load is large is shown by a solid line b in FIG. 6 while the power consumption is shown by a solid line c in FIG. 7, which is identical to that of the prior art apparatus shown by dotted lines d in FIG. 7. Of course, under this state of operation, it is impossible to decrease the power consumption. When the pump output increases beyond a predetermined quantity, due to an increase in the number of revolutions resulting in a high speed low pressure state in which the power steering apparatus does not operate under high load, as shown in FIG. 5*c*, the first spool valve 40 operates to release a portion of the pressurized oil from the first oil pump $P_1$ and flowing through the main path toward the tank T so as to control the quantity of the oil supplied to the power steering apparatus PS to be constant. Further, the supply quantity is decreased by the drooping action of the large diameter portion 68*a* of the stepped annular groove 68 that throttles the orifice 50 so as to maintain the supply quantity at the constant value at its predetermined position. At this time the second spool valve 41 is in the non-operative state so that the pressurized oil from the second pump $P_2$ is returned to the tank T through the discharge passage 37 and the inlet passage 32 of the second pump. Of course, a portion of the pressurized oil is returned to the tank T through the pump inlet passage 33 interconnected with the second pump discharge passage 36 via the first spool valve 40. The flow quantity characteristic is shown by the solid lines a, b and c interconnected by bend points X and Y of FIG. 6, while the power consumption is sufficiently small as shown by a solid line a, shown in FIG. 7.

Figure 5D:
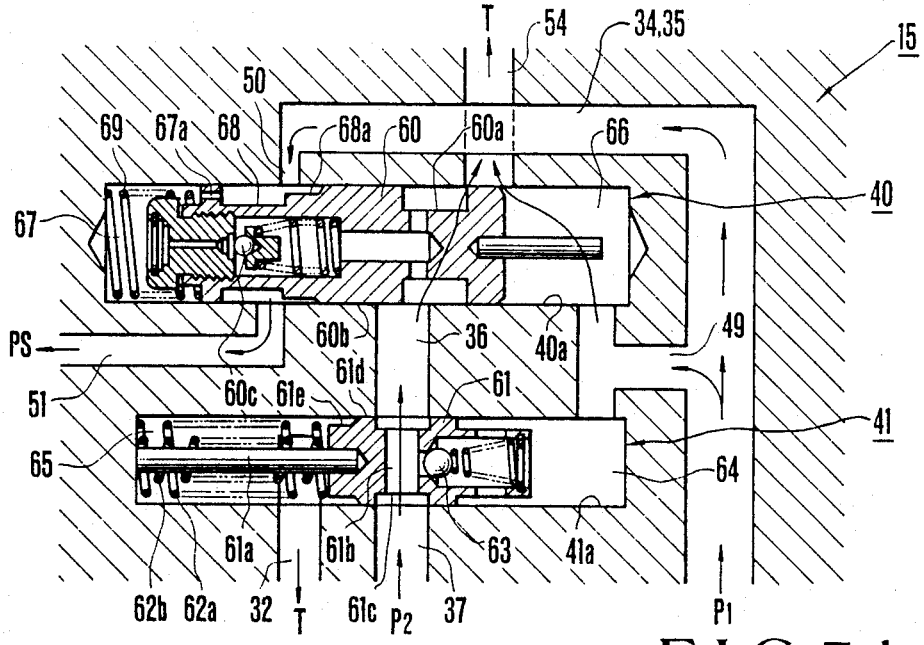

Furthermore, at the time of high speed running when the state becomes the high pressure state as the result of the operation of the power steering apparatus PS, as shown in FIG. 5*d*, both the first and second spool valves 40 and 41 operate with the result that the second pump $P_2$ would be connected to the pump inlet passage 33 via the second pump discharge passage 36 and the annular groove 60*a* of the first spool valve 40 in a manner as described above, thus communicating with the tank T. As a consequence, the pressurized oil from the second pump $P_2$ returns to the tank without opening the check valve 63. On the other hand, a portion of the pressurized oil from the first pump $P_1$ flowing through the main path is also returned to the tank T by the action of the first spool valve 40 so that the constant quantity of the pressurized oil would be supplied to the power steering apparatus PS. The flow quantity characteristic under this state is shown by a solid line e in FIG. 6 while the power consumption is shown by a solid line e connected to a solid line c in FIG. 7. This characteristic shows that the power consumption is only about one half of that of the prior art shown by dotted lines d in FIG. 7.

Figure 8:
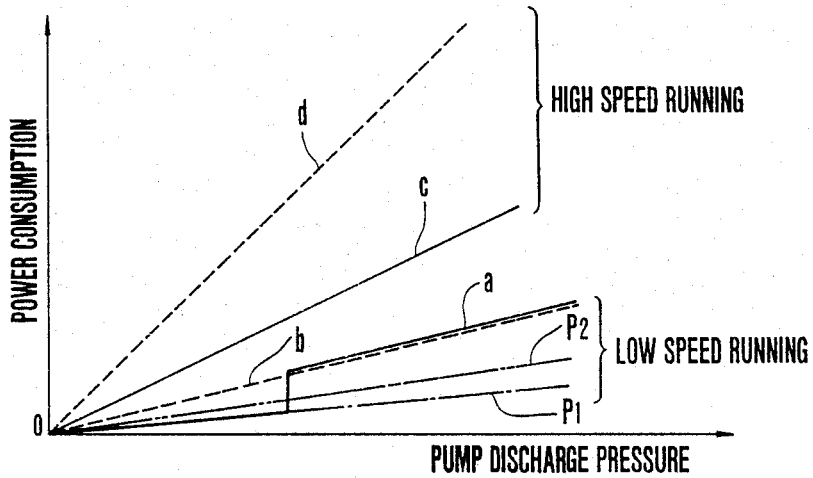
FIG. 8 is a graph showing the relationship between the pump discharge pressure and the pump power consumption.

The effect of energy saving of this embodiment can be clearly noted from the relation between the power consumption and the pump output pressure shown in FIG. 8.

When the number of revolutions of the pump lies in the low speed range, as shown by solid line a in FIG. 8, under the no load state, the power consumption may be about one half of the prior art apparatus as represented by dotted lines b shown in FIG. 8. At the load increases, the two lines acquire the same slope.

As shown by a solid line c in FIG. 8, in the high speed range the power consumption may be about one half of that of the prior art apparatus as represented by the dotted line d shown in FIG. 8. This significant reduction of power consumption is because at the time of high speed running, only the first pump $P_1$ supplies the pressurized oil to the power steering apparatus irrespective of the magnitude of the load and the second pump $P_2$ does not supply the pressurized oil.

As described above, in the oil pump 10 of this invention, a pair of spool valves 40 and 41 acting as a flow quantity control valve and a flow path switching valve are contained in two parallel spool valve bores 40*a* and 41*a* formed in a front body 15 of a pump body on the opposite sides of the rotary shaft of the rotor 12 and extending at right angles with respect to the axis of the rotor. Moreover, the spool valve bores 40*a* and 41*a*; inlet ports 32*a* and 33*a* opening into the pump chambers 30 and 31 in the pump cartridge 14; passages interconnecting the first and second discharge ports 34*a*, 35*a*, 36*a*, and 37*a*; and passages connected to the exit and inlet ports of the oil are formed by casing or a simple machining operation, thereby obtaining a pump which is compact, of simple construction, small in size, and lightweight, simplifying the manufacturing and the assembly of the pump.

Especially, as shown in this embodiment where a pair of spool valve bores 40*a* and 41*a* for receiving the spool valves 40 and 41 are formed in the front body parallel to each other and on the opposite sides of the rotary shaft 20 of the rotor 12, the intermediate space necessary for providing stable support for the shaft 20 is efficiently utilized resulting in a small and lightweight pump. Because the inlet ports 32*a* and 33*a*, respectively, opening into a pair of pump chambers 30 and 31 in the pump cartridge 14; the first and second discharge ports 34*a* and 35*a*, and 36*a* and 37*a*, being interconnected through connecting passages formed in the front body 15 or rear body 16; the pump inlet passages 32 and 33; and the first and second pump discharge passages extending from respective ports and opening into the two spool valve bores 40*a* and 41*a* are commonly used as the inlet passages and discharge passages for the pump chambers 30 and 31, the entire path construction can be simplified.

Furthermore, according to this invention, in the two pumps controlled in a manner as described above, the first and second discharge passages 34 and 35, and 36 and 37, are utilized for the pair of pump chambers 30 and 31 formed about the rotor 12, so that there is no fear of applying unbalanced loads on the rotor 12, thus improving the durability of the movable portions of the pump.

Although in the foregoing embodiment the spool valve bores 40*a* and 41*a* of the paired spool valves 40 and 41, are formed in parallel in the front body 15, in a direction substantially perpendicular to the rotary shaft 20 of the rotor, and are suitably connected with the inlet passages 32 and 33, first and second discharge passages 34 and 35, and 36 and 37, from respective pump chambers 30 and 31 of the pump cartridge 14, it should be understood that the invention is not limited to such construction and that both valves may be arranged in a similar positional relationship. Further, other paths and passages can be suitably changed.

Figure 9:
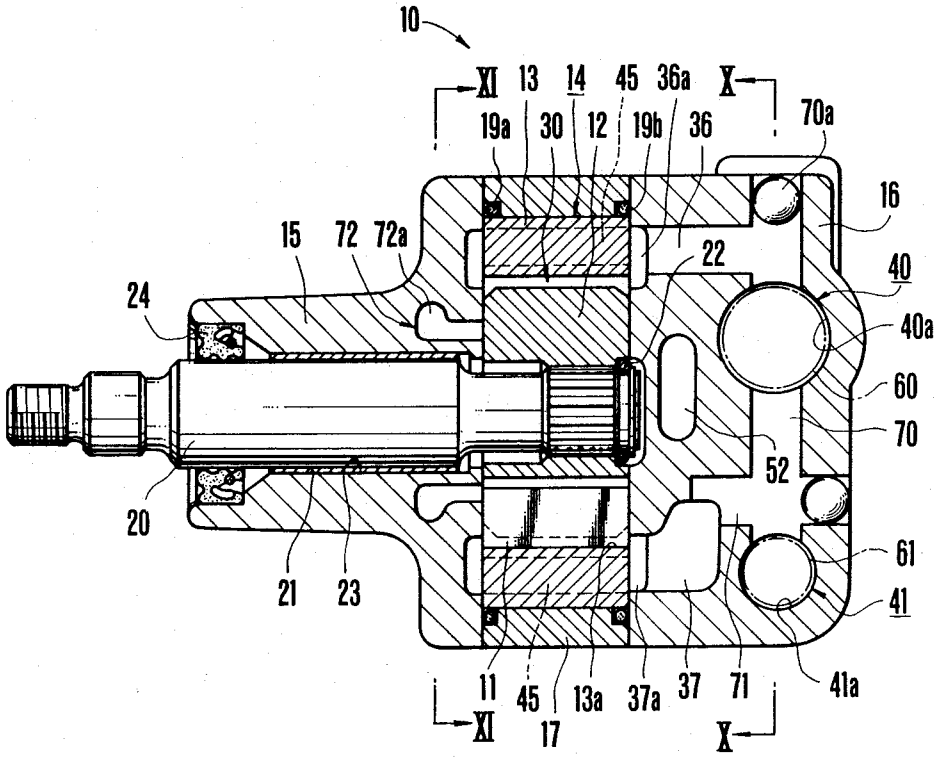
FIG. 9 is a longitudinal sectional view of a modified pump according to the present invention.
Figure 10:
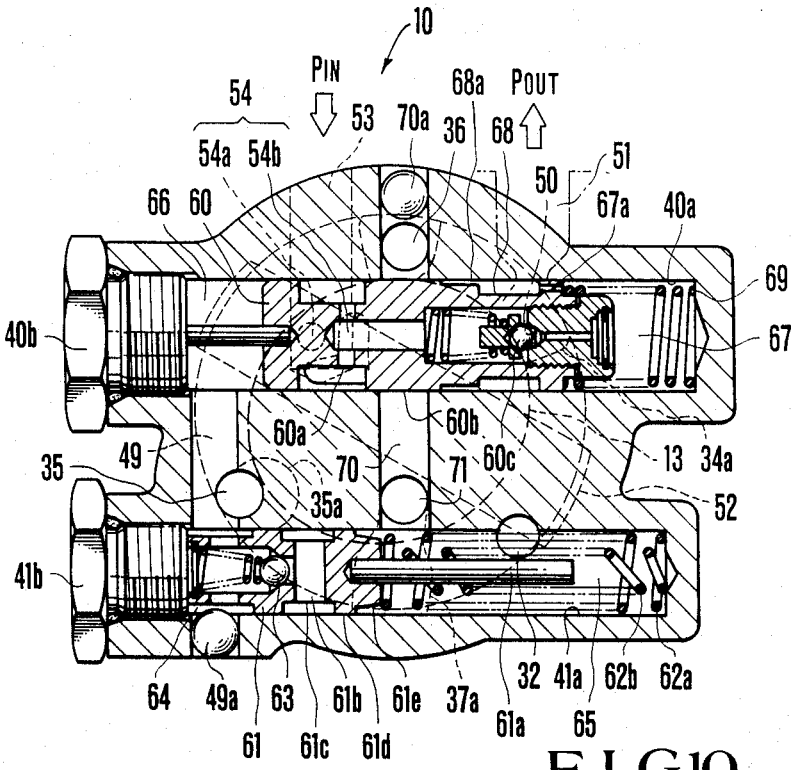
FIG. 10 is a cross-sectional view of the pump shown in FIG. 9 taken along line X—X.
Figure 11:
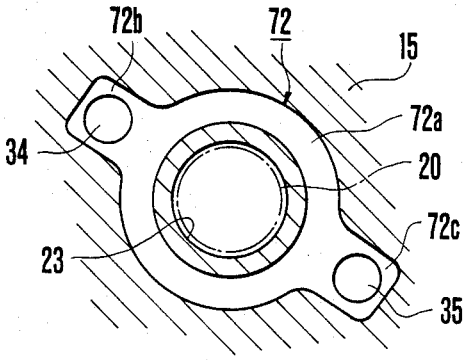
FIG. 11 is a cross-sectional view of the pump shown in FIG. 9 taken along line XI—XI.

FIGS. 9, 10, and 11 show a modified embodiment of the present invention, in which the spool valve bores 40*a* and 41*a* for a pair of spool valves 40 and 41 are formed in parallel in the rear body at right angles with respect to the rotary shaft 20 of the rotor 12 and in which parts identical or corresponding to those shown in FIGS. 1 through 4 are designated by the same reference numerals. Where the spool valve bores 40*a* and 41*a* are formed in the rear body 16, as in this modification, since the rotary shaft 20 is not located between the spool valve bores 40*a* and 41*a* as in the previous embodiment, a communication passage 70 interconnecting the second pump discharge passages 36 and 37 is formed in the vertical direction to intersect the spool valve bores 40*a* and 41*a* at substantially the center of their axial lengths. The upper end of the communication passage 70 is hermetically sealed by a ball 70*a*, and the lower end of the passage 70 is connected to the second pump discharge passage 37 (in this embodiment formed by a core used during casting) via a passage 71. Similarly, the communication passage 52 interconnecting the inlet passages 32 and 33 is formed with a core in the rear body at a position closer to the cartridge 14 than the passage 70. As shown in FIG. 11, a passage 72 interconnecting the first pump discharge passages 34 and 35 is formed by an annular member 72*a* surrounding the shaft opening 23 in the front body 15 and radial extensions 72*b* and 72*c* of the annular member 72*a*. The inlet passages 32 and 33 and the first pump discharge passages 34 and 35 are connected to the spool valve bores 40*a* and 41*a* in the same positional relation as in the first embodiment.

Other elements have the same construction as those shown in the first embodiment and operate in the same manner.

As described above, in the oil pump 10 according to the present invention, a pair of spool valves acting as a flow quantity control valve and a flow path switching valve are parallelly disposed in the front body 15 or the rear body 16 in a direction substantially perpendicular to the rotary shaft 20 of the rotor 12; pump inlet passages 32 and 33; and the first and second discharge passages 34 and 35, and 36 and 37, opening in pump chambers 30 and 31 in the pump cartridge 14 constitute a suitably interconnected network of passages formed in the front and rear bodies 15 and 16 which are easily machined or cast so that machining and assembly of various component elements can be simplified. Accordingly, it is possible not only to make the pump smaller and lightweight, but also to decrease the manufacturing cost.

It should be understood that the invention is not limited to the specific embodiments described above and that many changes and modifications will be obvious to one skilled in the art. For example, in the embodiments, although passages formed through the cam ring 13 of the pump cartridge 14 were used to interconnect passages formed in the front and rear bodies, such passages may be formed by passages or grooves formed on the outer periphery of the cam ring 13 and the outer annular member 17. Furthermore, the cam ring 13 and the outer annular member 17 may be formed as an integral unit instead of separate members.

Further, in the foregoing embodiments, the oil pump 10 is used to drive a power steering apparatus. Any other oil pressure apparatus can be driven by the oil pump of the present invention, which apparatus is required to be driven by a small and compact oil pump.

The control unit can also be modified to meet different operating conditions by forming openings through the pump body with a drill or changing the shape of the spool.

As described above, according to the present invention paired inlet passages and two sets of discharge passages, respectively opening in a pair of pump chambers formed in a cartridge, are formed in the pump body; parallelly disposed spool valves acting as a flow quantity control valve and a pressure sensitive flow path switching valve, are formed in the pump body in a direction perpendicular to the axis thereof; and, various paths and passages are suitably connected to the spool valves in order to facilitate the manufacturing and assembly of various component parts and further to make a compact and lightweight pump. Since the oil pump of the present invention is of the balanced vane type the durability and reliability of the movable parts of the oil pump are improved. Moreover, since various passages are arranged efficiently the pressure loss therein can be minimized, thus saving energy. Furthermore, as the passages in the pump body are formed by machining and/or casting, various elements can be readily manufactured and worked. In particular, according to the present invention, since two spool valve bores are disposed parallel they can be readily formed by drilling in the same direction. Moreover, the communication passages can be formed by axially aligning the spool valve bores and inlet and discharge ports of the respective pump chambers of the pump cartridge, thus simplifying the construction of the passages.

What is claimed is:

1. An oil pump comprising:

a pump body having a rotary shaft;

a single rotor mounted to said rotary shaft for rotation therewith, said single rotor having a plurality of radially movable vanes; a cam ring coaxially mounted with said single rotor and rotatably containing said single rotor to define a pair of pump chambers, each of said pump chambers comprising:

an inlet passage;

a first discharge passage spaced a predetermined distance in a direction of rotation of said single rotor from said inlet passage; and a second discharge passage spaced a predetermined distance in a direction of rotation of said single rotor from said first discharge passage;

a first valve bore extending in a direction substantially perpendicular to said rotary shaft;

a second valve bore spaced a predetermined distance from said first valve bore and further being parallel thereto;

first and second spool valve means, said second spool valve means mounted in said second valve bore, said second spool valve means operative to selectively connect and disconnect said second discharge passage of each one of said pair of pump chambers to one of said inlet passages of said pump, said second spool valve means further operative to selectively connect said second discharge passages of said pump chambers to said first discharge passages of said pump chambers; and said first spool valve means mounted in said first valve bore, said first spool valve means selectively operative to connect said first and second discharge passages of said pair of pump chambers to the other of said inlet passages.

2. The oil pump according to claim 1 wherein said pump body further comprises front and rear bodies which clamp said cam ring therebetween.

3. The oil pump according to claim 2 wherein said first and second valve bores are formed in said front body.

4. The oil pump according to claim 2 wherein said first and second valve bores are formed in said rear body.

* * * * *

UNITED STATES PATENT AND TRADEMARK OFFICE

CERTIFICATE OF CORRECTION

PATENT NO. : 4,838,767

DATED : June 13, 1989

INVENTOR(S) : Ohe et al

It is certified that error appears in the above-identified patent and that said Letters Patent is hereby corrected as shown below:

Column 5, line 65, delete "an d" and insert ---- and ----.

Column 8, line 40, delete "$P_1$" and insert ---- $P_2$ ----.

Column 9, line 33, delete "b" and insert ---- b, ----.

Column 10, line 24, delete "casing" and insert ---- casting ----.

In the Abstract

Line 2, delete "chambrs" and insert ---- chambers ----.

Signed and Sealed this

Eighteenth Day of December, 1990

*Attest:*

HARRY F. MANBECK, JR.

*Attesting Officer*

*Commissioner of Patents and Trademarks*